US006494772B1

(12) United States Patent
Barnes et al.

(10) Patent No.: US 6,494,772 B1
(45) Date of Patent: Dec. 17, 2002

(54) FLOOR CONDITIONING SYSTEM

(76) Inventors: Roger W. Barnes, 2316 Manor Rd., Clymer, PA (US) 15728; Cyrus W. Kirsch, 3231 Laurel Run Rd., Penn Run, PA (US) 15765; Kenneth D. Palmer, 3231 Laurel Run Rd., Penn Run, PA (US) 15765

( * ) Notice: Subject to any disclaimer, the term of this patent is extended or adjusted under 35 U.S.C. 154(b) by 0 days.

(21) Appl. No.: 09/502,645

(22) Filed: Feb. 11, 2000

Related U.S. Application Data

(60) Provisional application No. 60/168,174, filed on Nov. 30, 1999.

(51) Int. Cl.[7] ..... B24B 23/03

(52) U.S. Cl. ..... 451/353; 451/357; 451/350; 451/270; 15/49.1; 15/98; 15/385

(58) Field of Search ..... 451/353, 357, 451/270, 350; 15/49.1, 98, 385, 386

(56) References Cited

U.S. PATENT DOCUMENTS 4,097,950 A * 7/1978 Satterfield ..... 15/49 R
5,070,656 A * 12/1991 Brogden ..... 451/350
5,355,542 A * 10/1994 Oreck et al. ..... 15/49.1
5,863,241 A * 1/1999 Rottschy ..... 451/271
5,879,228 A * 3/1999 Sun ..... 451/357
6,224,471 B1 * 5/2001 Clowers et al. ..... 451/359

* cited by examiner

*Primary Examiner*—George Nguyen
(74) *Attorney, Agent, or Firm*—John J. Elnitski, Jr.

(57) ABSTRACT

The present invention is floor conditioning system. The floor conditioning system improves the ease of use as compared to currently available sanding or polishing devices. Thereby, allowing the unsophisticated do-it-yourselfers to use a floor conditioning system. The floor conditioning system provides a random rotating orbital action which greatly improves the ability to control a floor conditioning system as well as providing a much nicer job of conditioning a floor. The floor conditioning system includes a main housing, wheel assembly, a handle assembly, a motor, a belt cover, a belt, a dust recovery system and orbital head assemblies.

25 Claims, 16 Drawing Sheets

FLOOR CONDITIONING SYSTEM

This application claims the benefit of U.S. Provisional Application No.: 60/168,174 filed Nov. 30, 1999.

BACKGROUND

Reconditioning of a floor usually requires polishing or sanding of the floor. Polishing of a floor is done to clean and shine a floor. It has been found that the floor polishers available are difficult to control and use by an inexperienced operator. Sanding is often required when installing, renovating or repairing hardwood floors. The sanding of a hardwood floor is preferably accomplished in two steps, each requiring the use of a separate piece of equipment. The first piece of equipment used is generally a drum sander. The drum sander essentially includes a cylindrical drum, around which a strip of abrasive material is secured. A motor rotates the drum along with the strip of abrasive material. The drum is moved around the hardwood floor surface and sands it smooth. Drum sanders are primarily used first because of their ability to quickly and efficiently sand large areas of hardwood floors. However, drum sanders tend to chatter and vibrate, leaving chatter marks and/or other imperfections showing on the floor. Thus, the quality of the surface finish is somewhat impaired. These disadvantages are generally due to the gap or slot in the drum where the abrasive material is inserted and secured. Another disadvantage is that the drum sander has found wide use in the rental industry for the do-it-yourselfer. The problem with a do-it-yourselfer is the person rarely has the experience to operate the difficult to use drum sander and thereby actually does more harm than good when sanding floors.

After drum sanding is complete, a belt-type sander can be used to provide the desired surface finish. Belt-type sanders essentially include a sanding drum and a tension roller adjacent the drum. An endless belt of abrasive material is arranged around the drum and tension roller. The drum is then driven by a motor causing the belt to rotate and abrade the hardwood surface. This continuous sanding belt allows belt-type sanders to typically produce a higher quality surface finish than drum-type sanders. However, belt sanders are considerably more expensive to operate than drum sanders due to the expensive and rapidly consumed endless belts utilized. As a result, belt sanders are more efficient for the final or finish sanding of the floor, after the drum sander has been used. But, this means the do-it-yourselfer must rent two machines for sanding a floor. Thus, there is a need for a single device for floor conditioning which allows ease of use for the do-it-yourselfer and reduces the number of machines needed to condition a floor.

It is an object of the present invention to provide a device for conditioning floors which is easier to operate for the do-it-yourselfer, who rents such a machine, but lacks the operating experience of such devices.

SUMMARY OF THE INVENTION

The present invention is a floor conditioning system for conditioning floors. The floor conditioning system includes at least one orbital head assembly which provides a random rotating orbital action onto the floor during conditioning of the floor; a motor to drive the at least one orbital head assembly; a housing to secure the at least one orbital head assembly and the motor in place; and a handle attached to the housing to control the floor conditioning system. The one orbital head assembly includes an orbital head having a top and bottom, the top adapted to be connected to the motor; a conditioning head attachment shaft extending outward from the bottom of the orbital head and offset from a center of the orbital head, the conditioning head shaft rotatable in relation to orbital head; and a conditioning head having a top adapted to attach to the conditioning head attachment shaft and a bottom for attaching a pad for conditioning the floor. The floor conditioning system provides a device is easier to use as compared to currently available sanding and other floor conditioning devices. This is because the device of the present invention provides a method of conditioning a floor by applying a random rotating orbital conditioning action onto the floor that is easier to control by the operator. Also, the floor conditioning system includes a conditioning head which includes a bottom surface that is flexible and concave. The concave bottom surface improves conditioning time and efficiency of a floor conditioning device.

DETAILED DESCRIPTION

Figure 1:
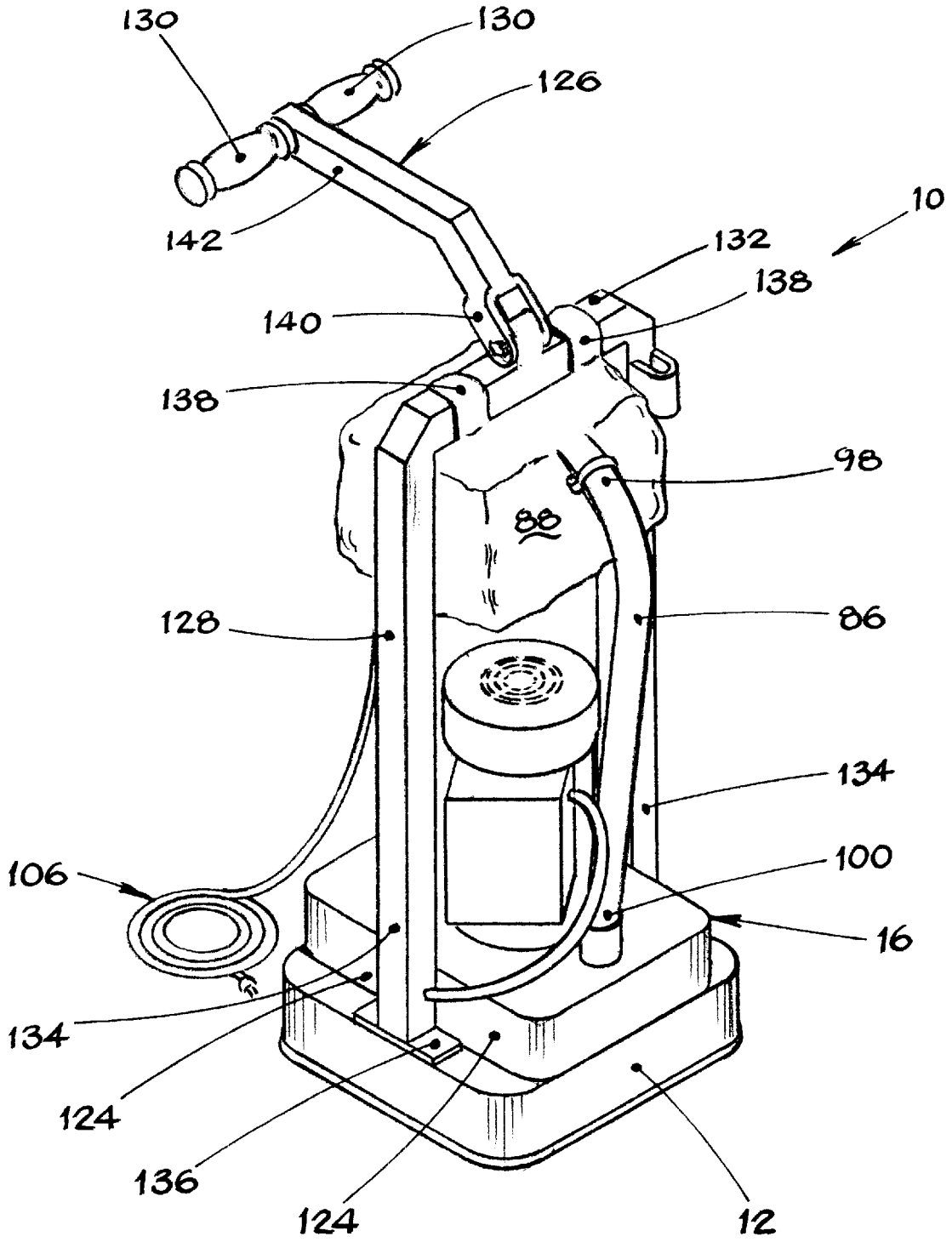
FIG. 1 is a front perspective view of the floor conditioning system according to the present invention.
Figure 2:
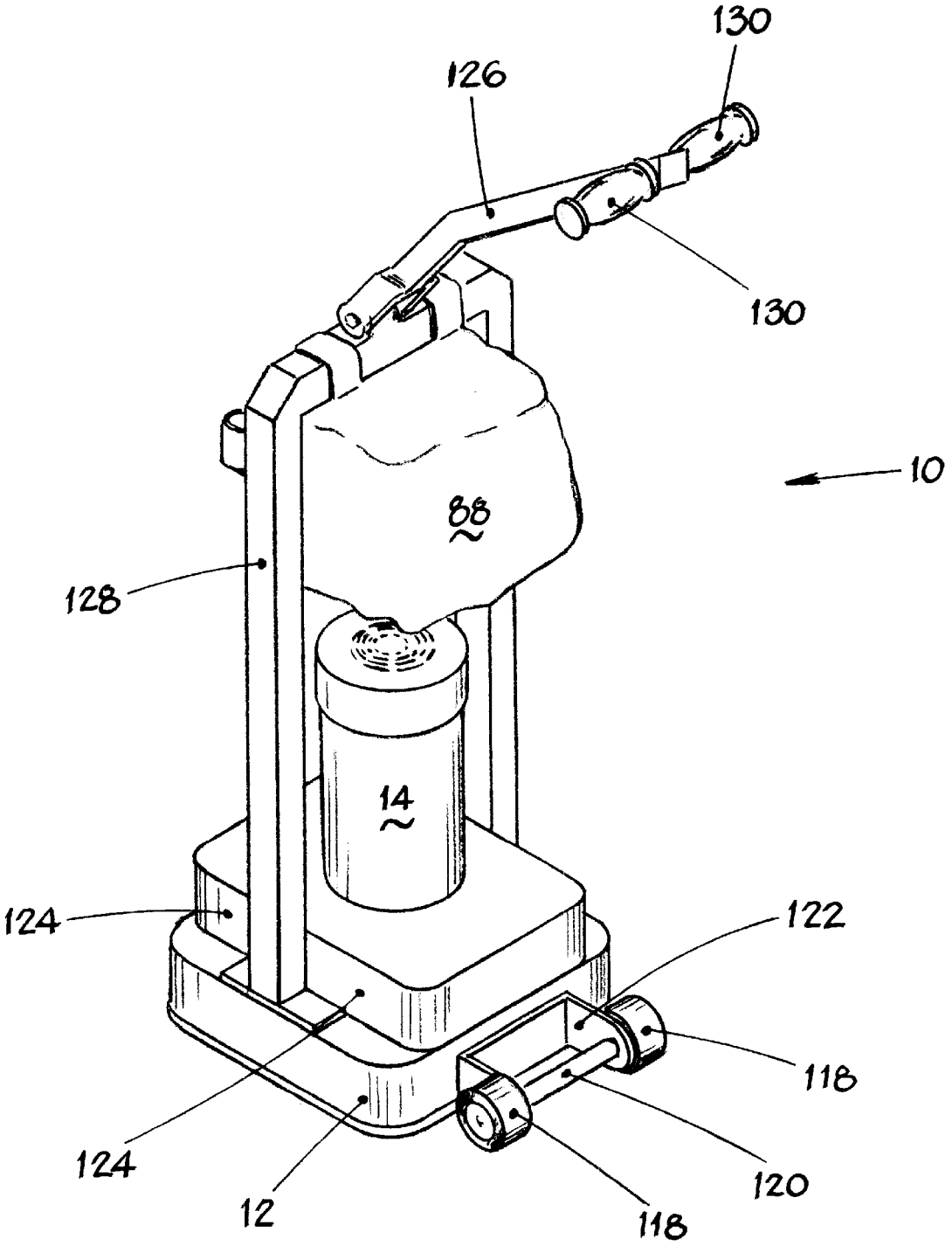
FIG. 2 is a rear perspective view of the floor conditioning system according to the present invention.
Figure 3:
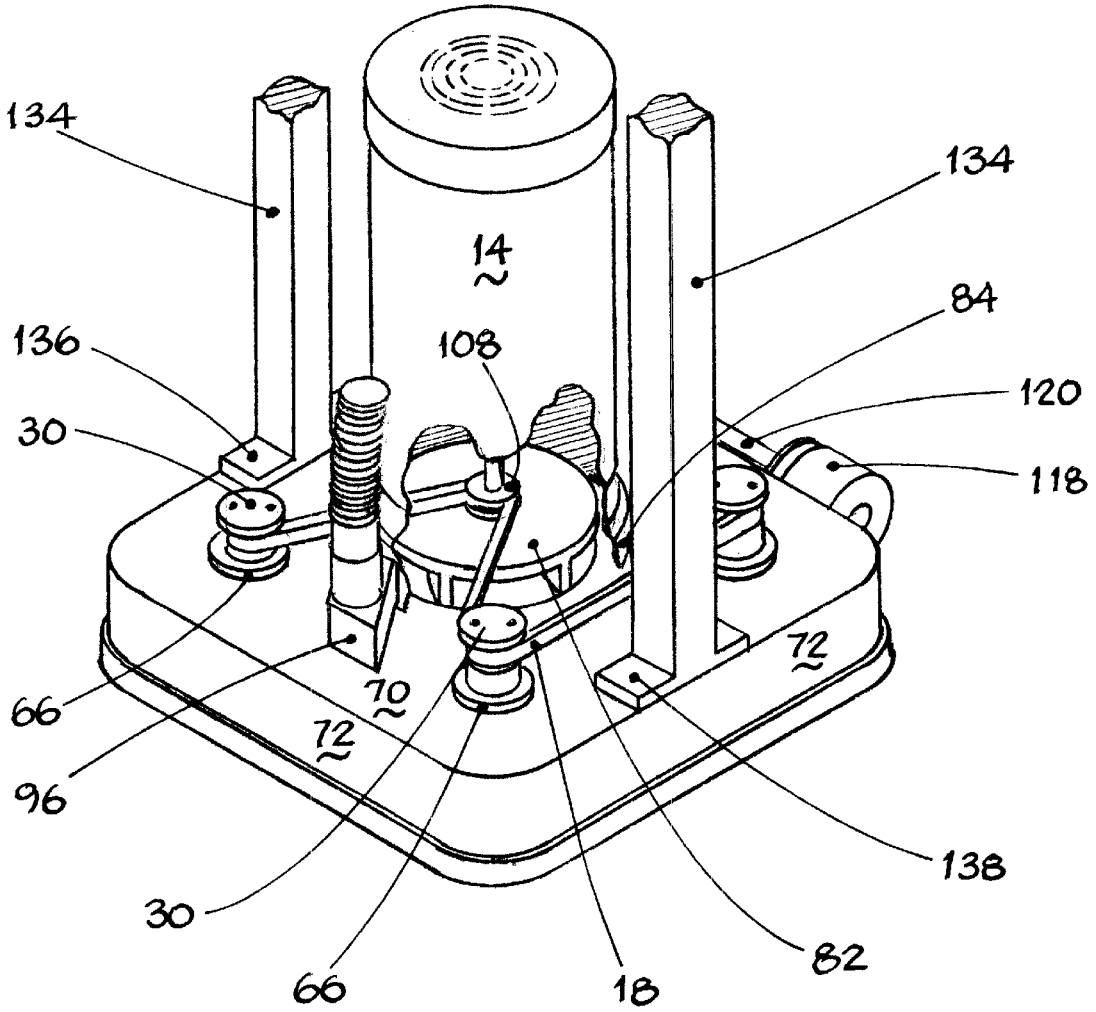
FIG. 3 is a partial perspective view of the floor conditioning system according to the present invention.
Figure 4:
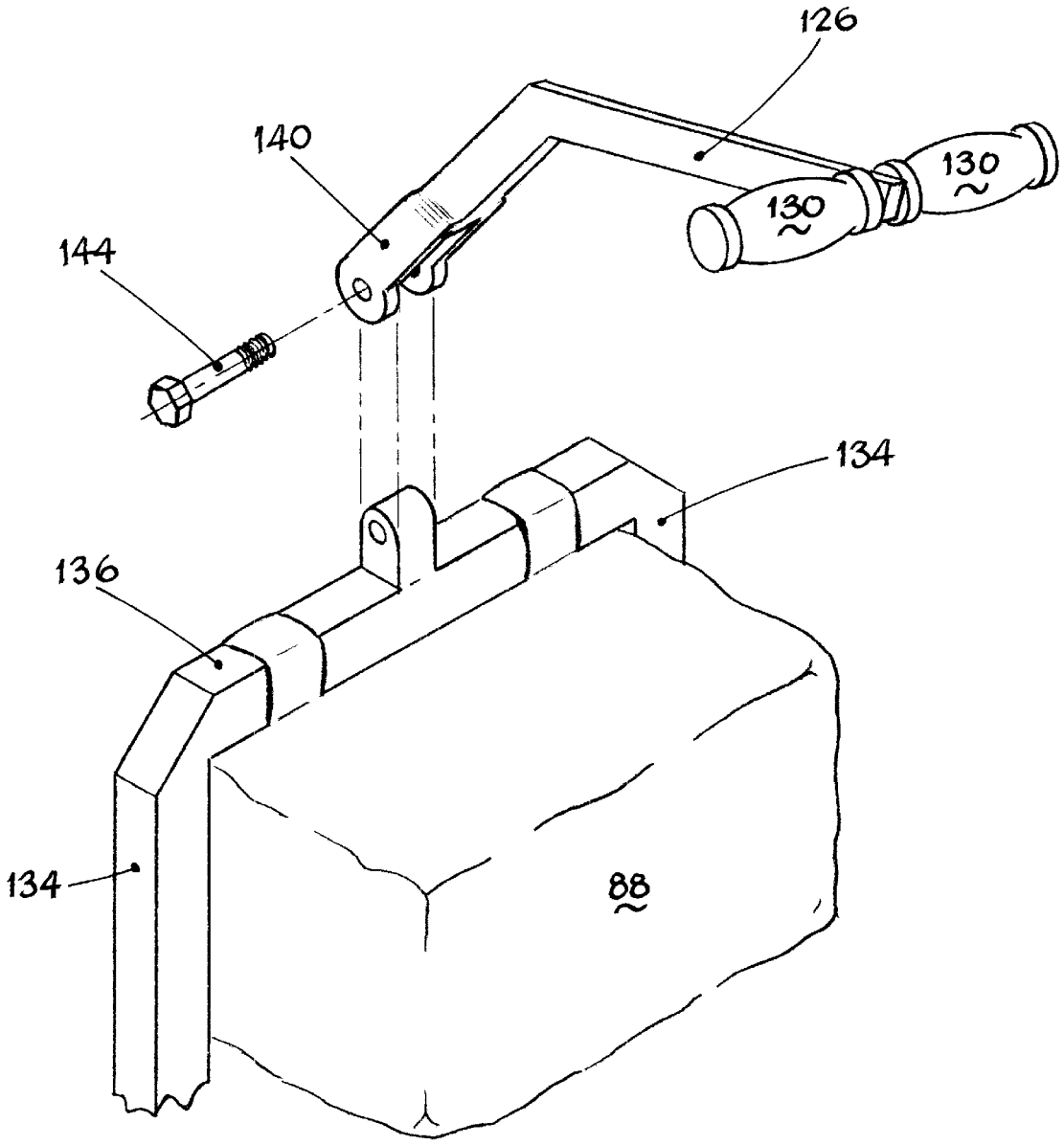
FIG. 4 is a partial exploded view of an upper end of the floor conditioning system according to the present invention.

The present invention is floor conditioning system. The floor conditioning system is shown and described as a floor sander 10, but can be easily converted to do other types of floor conditioning, by changing the type of conditioning pad. The floor conditioning system improves the ease of use as compared to currently available devices due to a random rotating orbital action when conditioning the floor. Thereby, allowing the unsophisticated do-it-yourselfer to use the floor conditioning system. The floor sander 10 is shown in FIGS. 1–15. The floor sander 10 provides a random rotating orbital sanding action which greatly improves the ability to control it as well as providing a much nicer job of sanding a floor. Thus, removing the need for using two types of sanders. The floor sander 10 includes a main housing 12, wheel assembly, a handle assembly, a motor 14, a belt cover 16, a belt 18, a dust recovery system and four orbital head assemblies 20.

Figure 5:
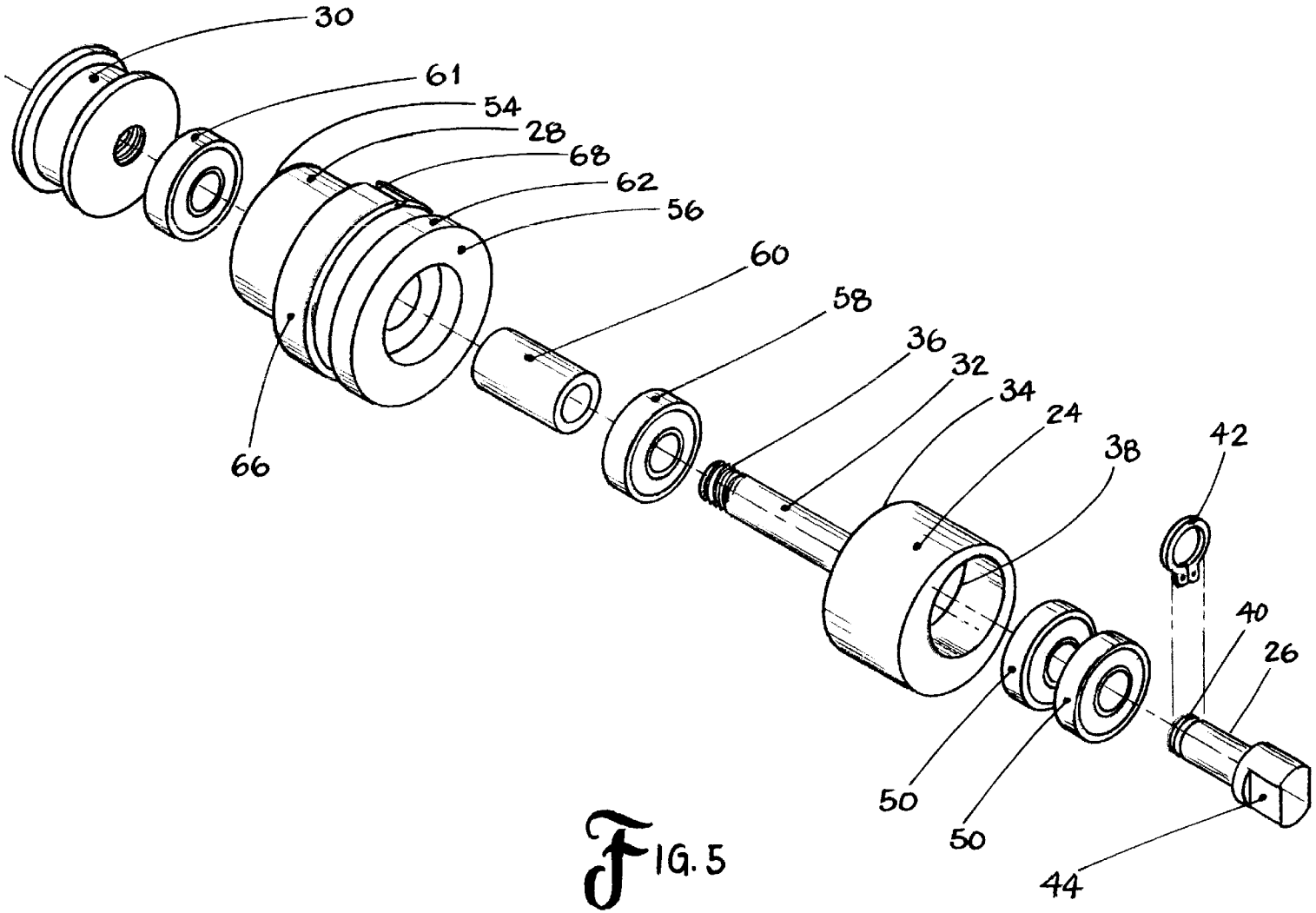
FIG. 5 is an exploded view of an orbital head assembly according to the present invention.
Figure 6:
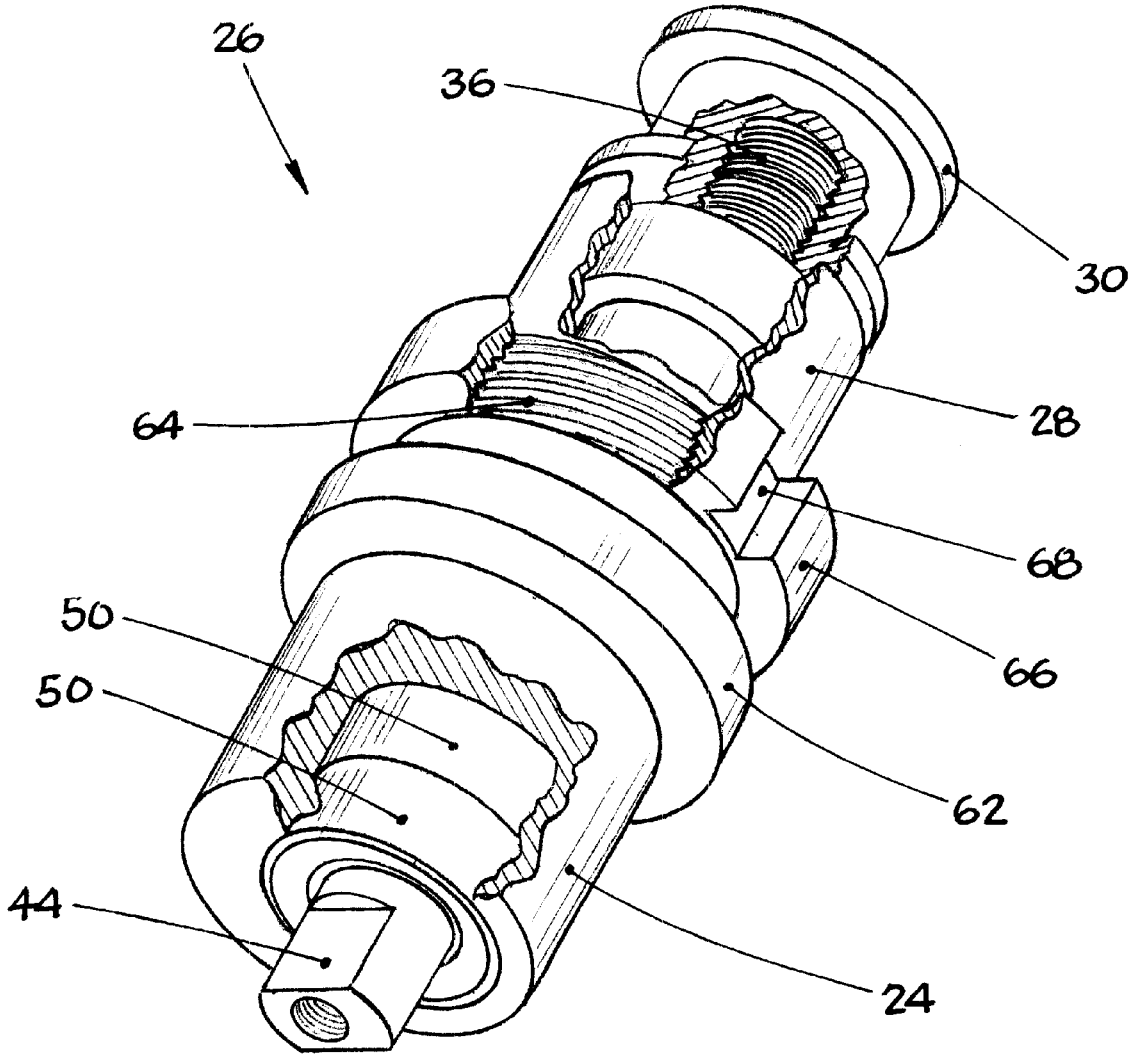
FIG. 6 is a cut-a-way view of an orbital head assembly according to the present invention.
Figure 7:
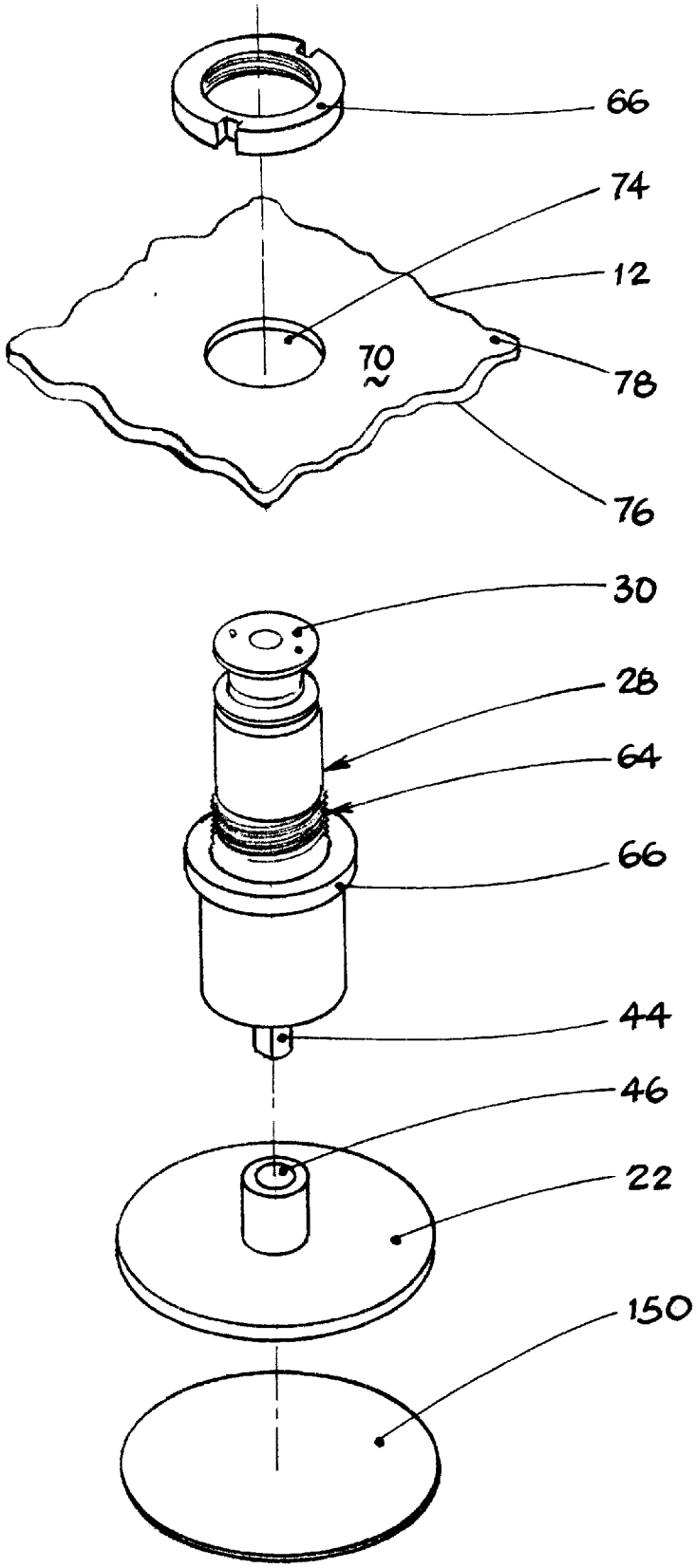
FIG. 7 is an exploded view of an orbital head assembly attached to a housing according to the present invention.
Figure 8:
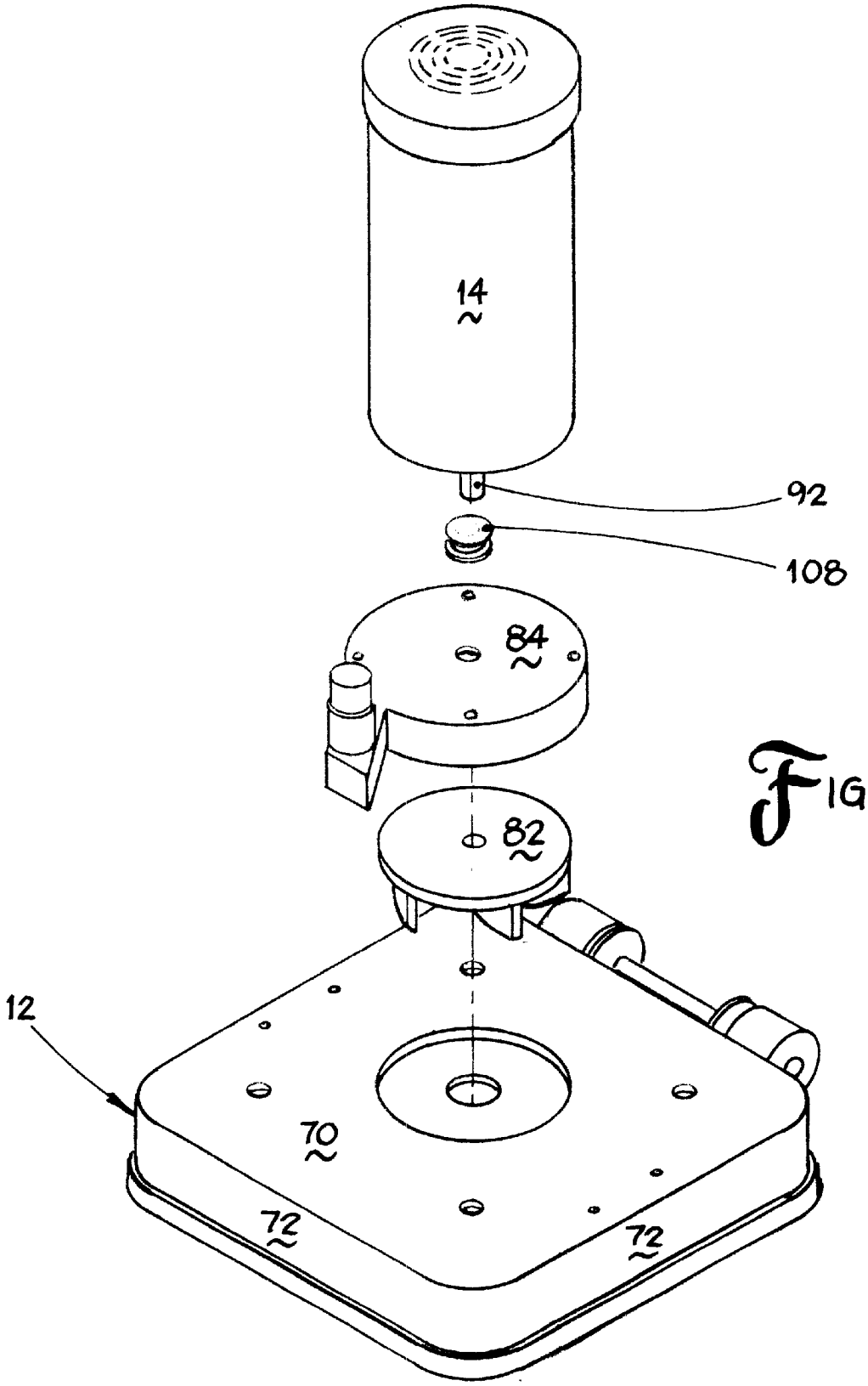
FIG. 8 is an exploded view of a motor attached to a housing according to the present invention.
Figure 9:
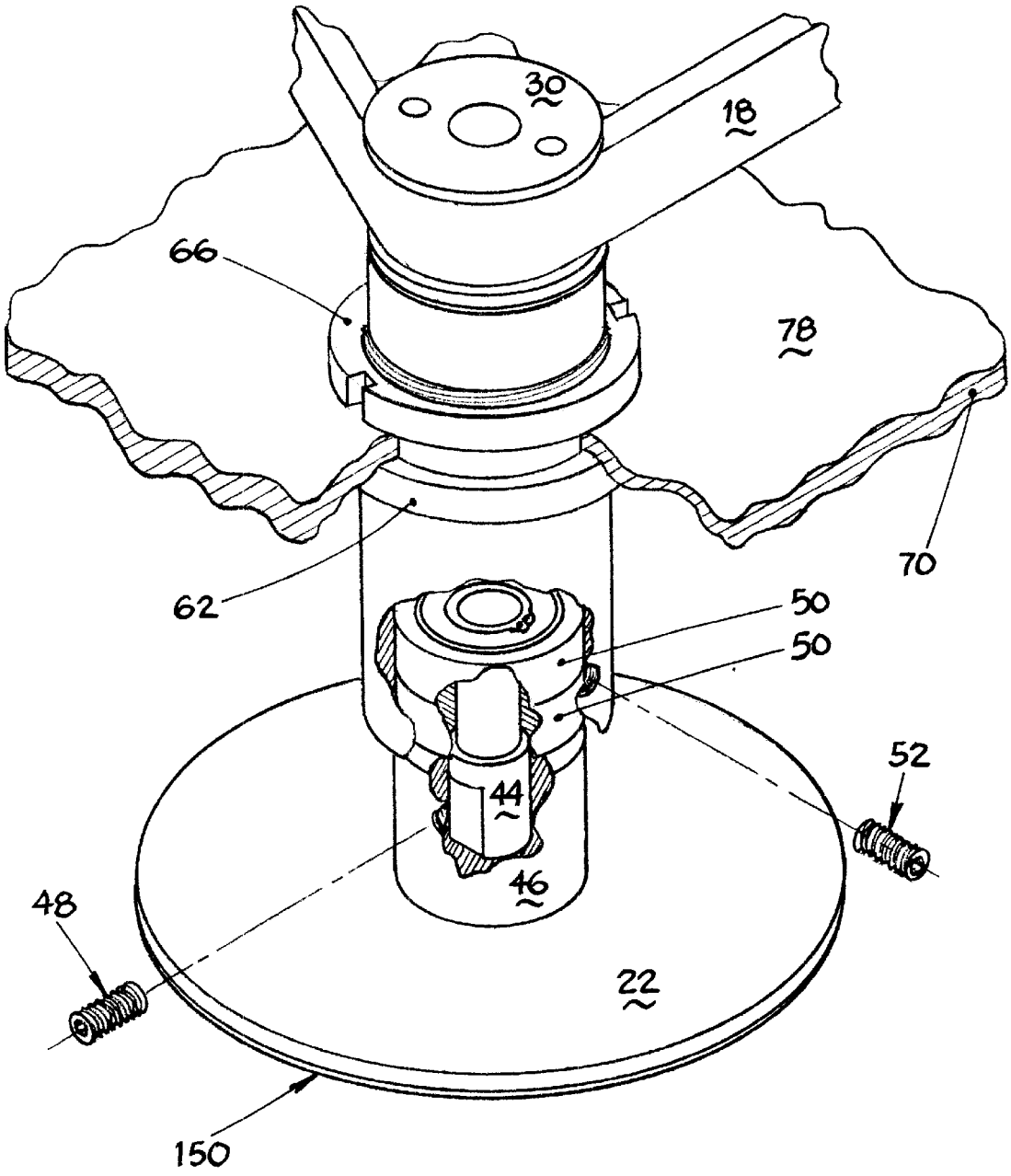
FIG. 9 is a cut-a-way view of an orbital head assembly attached to a housing according to the present invention.
Figure 10:
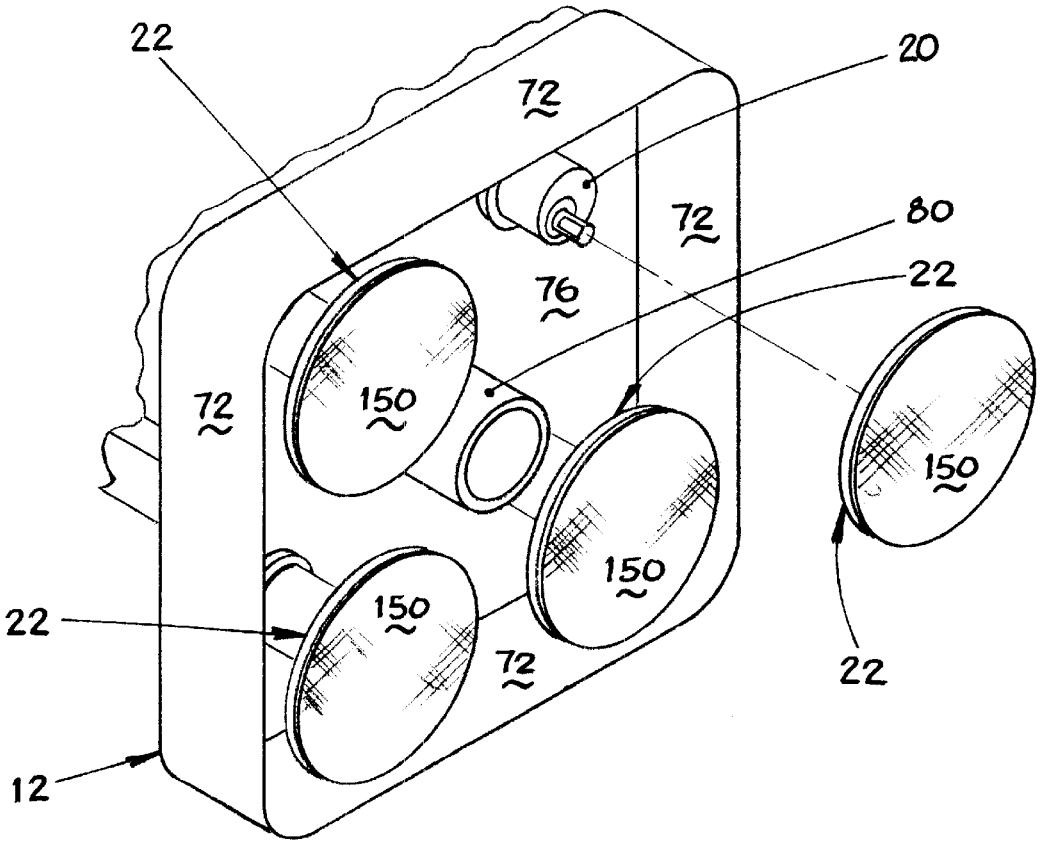
FIG. 10 is a lower perspective view of the floor conditioning system according to the present invention.
Figure 11:
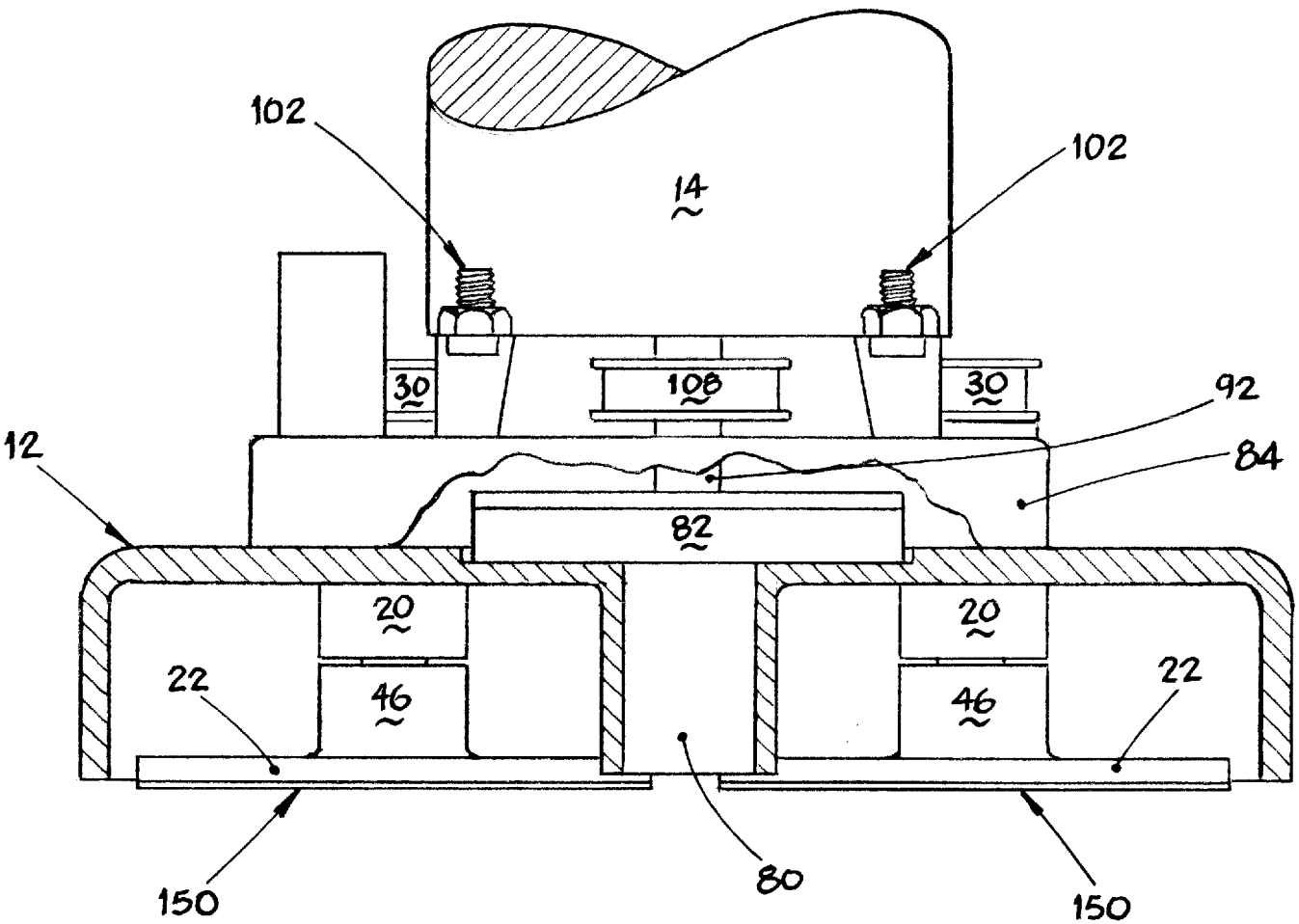
FIG. 11 is a lower cross-sectional view of the floor conditioning system according to the present invention.
Figure 12:
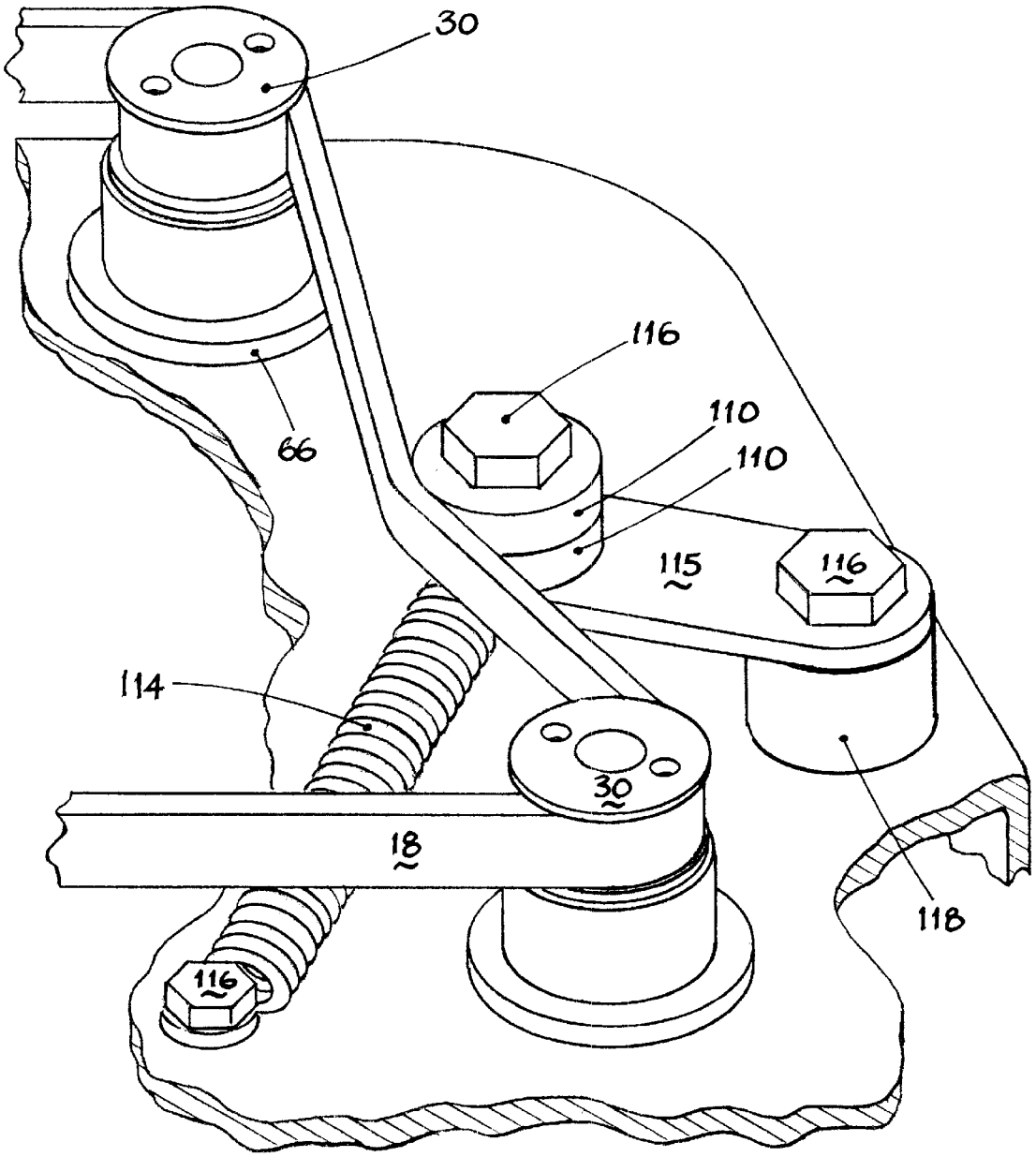
FIG. 12 is a partial perspective view of the belt and pulleys of the floor conditioning system according to the present invention.
Figure 13:
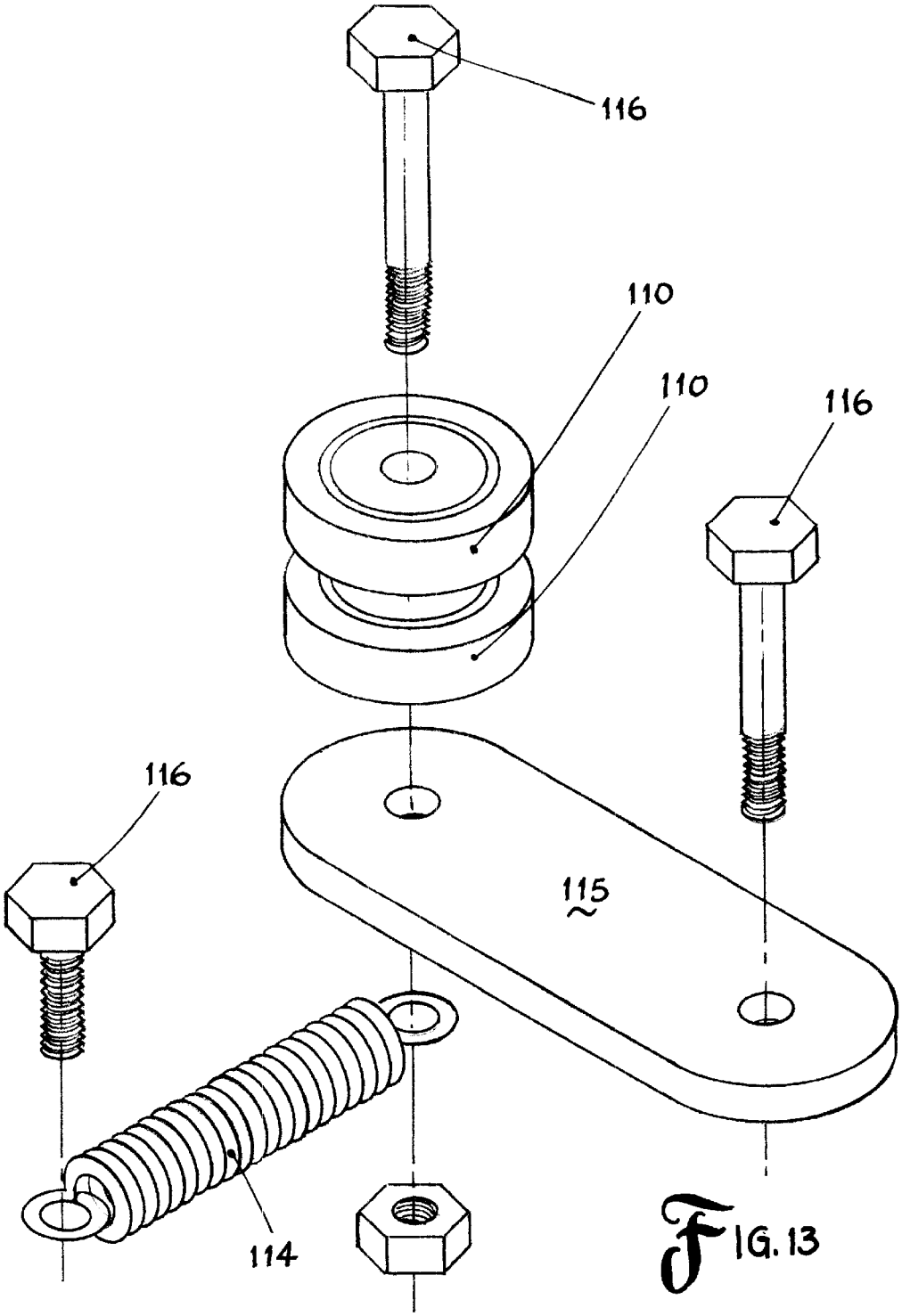
FIG. 13 is an exploded view of a belt tensioner according to the present invention.
Figure 16:
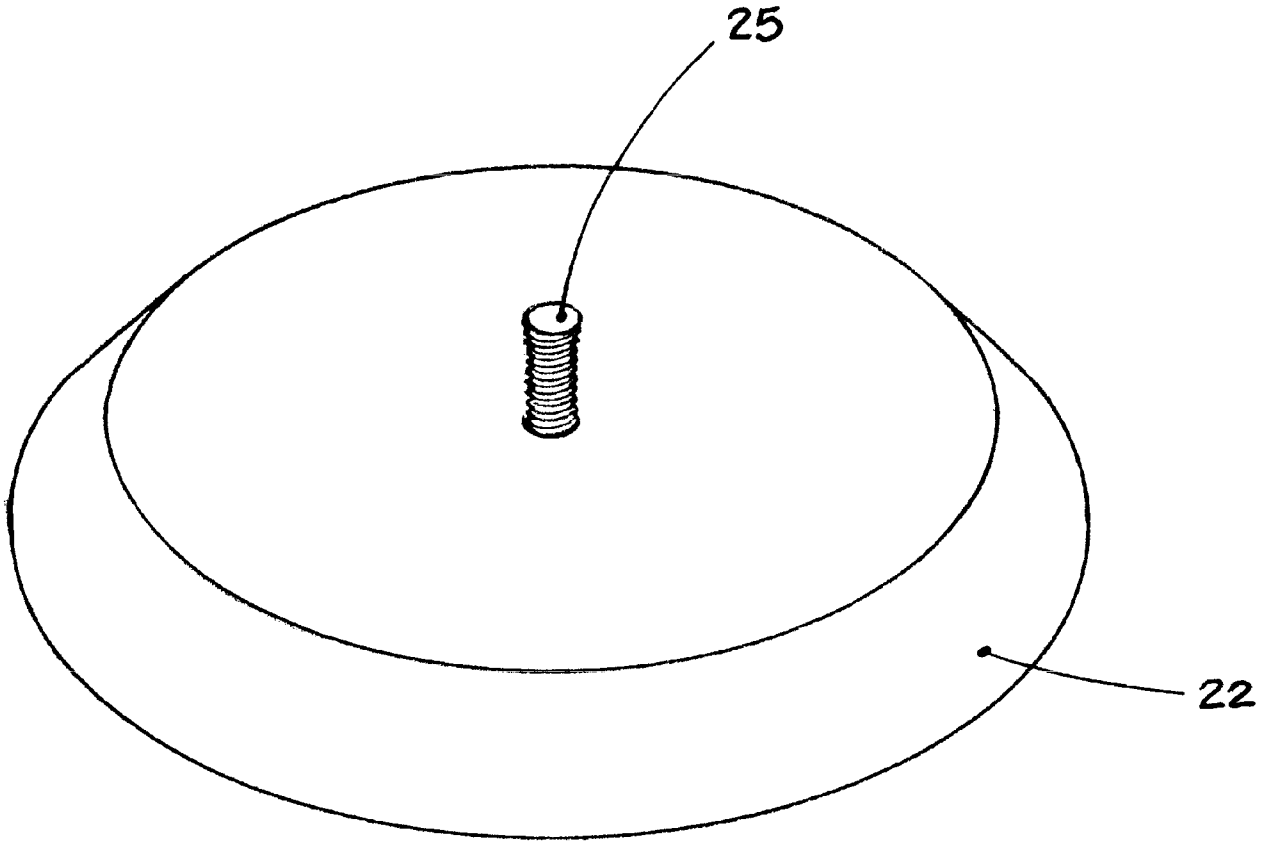
FIG. 16 is a perspective side view of a conditioning head according to the present invention.

The orbital head assemblies 20 include a conditioning head 22, a orbital head 24, a conditioning head attachment shaft 26, a housing attachment head 28 and a pulley 30. The orbital head assemblies 20 provide the random orbital action to the floor. The orbital head 24 includes a main shaft 32 extending from a top end 34 of the orbital head 24. The main shaft 32 includes a threaded end 36. The orbital head 24 has a milled out hole 38 in the bottom of the orbital head 24. The milled out hole 38 is offset from the center of the orbital head 24. This offset aids in providing the random rotating orbit action of the conditioning head 22. The conditioning head attachment shaft 26 includes a groove 40 on one end to receive a snap ring 42. The conditioning head attachment shaft 26 also includes a stud 44 for sliding over a socket 46 of the conditioning head 22. The conditioning head 22 is attached by mounting socket 46 over the stud 44. A set screw 48 through the socket 46 and against the stud 44 secures the conditioning head 22. FIG. 16 shows a different version of the conditioning head 22. The conditioning head 22 is shown with a threaded stud 25 extending from the conditioning head 22. To connect the conditioning head 22 to the conditioning head attachment shaft 26, the threaded stud 25 is screwed into a hole 27 at the end of the stud 44, as shown in FIGS. 5–6. Two bearings 50 slide over the conditioning head attachment shaft 26. The snap ring 42 retains the two bearings 50 on the conditioning head attachment shaft 26. The two bearings 50 are sized to fit into the milled out hole 38 of the orbital head 24 and aid in providing the orbital action of the conditioning head 22. The bearings 50 allow the conditioning head attachment shaft 26 and thus the conditioning head 22 to rotate independently of the rotating orbital head 24, due to contact of the conditioning head 22 with the floor. This dual rotation of the conditioning head attachment shaft 26 rotating independently of the orbital head 24 provides the random rotating orbital action, whereby each conditioning head 22 is applied randomly to the floor. The bearings 50 are held in orbital head 24 by a set screw 52. The housing attachment head 28 includes a top 54 and a bottom 56. The bottom 56 is milled out to receive a bearing 58 and a spacer 60. The entire housing attachment head 28 is milled out to allow the threaded end 36 of the main shaft 32 to pass through the bottom 56, the bearing 58 and the spacer 60 on through the top 54 of the housing attachment head 28. The top 54 of the housing attachment head 28 is milled out to receive a bearing 61 which slides over the main shaft 32. The housing attachment head 28 also includes a collar 62, a threaded middle 64 above the collar 62 and a detachable threaded ring 66 having two notches 68. Whereby, the threaded ring 66 slips over the top of the housing attachment head 28 and screws onto the threaded middle 64 and against the collar 66. Finally, the pulley 30 has a threaded center to allow the pulley 30 to be attached to the main shaft 32 by screwing the pulley 30 on the threaded end 36 of the main shaft 32.

The main housing 12 allows the attachment of all the other components of the floor sander 10. The main housing 12 includes a top 70 and four sides 72. The orbital head assemblies 20 are attached to the main housing 12 by removing the threaded ring 66 and sliding the top 54 of the housing attachment head 28 through holes 74, such that the collars 66 rest against an inside surface 76 of the top 70 of the main housing 12. The threaded ring 66 is then threaded onto the housing attachment head 28 and against an outside surface 78 of the main housing 12. Whereby, the threaded ring 66 and the collar 62 hold the housing attachment head 28 in place on the main housing 20. The notches 68 on the threaded ring 66 are for tightening the threaded ring 66 on the housing attachment head 28 using a spanner type wrench. The threaded ring 66 and threaded middle 64 are shown large enough to allow the threaded ring 66 to pass over the pulley 30.

The dust recovery system includes a suction tube 80, impeller 82, impeller housing 84, hose 86 and dust bag 88. The main housing 12 includes a hole 90 in the center to receive the suction tube 80. The suction tube 80 is secured to the main housing 12 and extends downward from the top 70 of the main housing 12 until it almost reaches the surfaced to be sanded. Mounted to the outside surface 78 of the top 70 of the main housing 12 and above the suction tube 80 is the impeller housing 84. The impeller 82 is contained within the impeller housing 84. The impeller housing 84 is a circular housing providing a volume for the impeller 82. The impeller 82 is mounted to an end of a motor shaft 92 extending from the motor 14. The motor shaft 92 extends through a hole 94 in the impeller housing 84 to reach the impeller 82. The impeller housing 84 includes a dust exit 96 in which a first end 98 of the hose 86 is mounted. A second end 100 of the hose 86 is mounted to the dust bag 88, which is mounted to the handle assembly.

The motor 14 mounts to the impeller housing 84 using bolts 102. The bolts 102 pass through the top 70 of the impeller housing 84 from an inside surface 85 of the impeller housing 84 and screw into the face 104 of the motor 14. The motor 14 includes an electrical cord 106 which runs through the handle assembly. A motor pulley 108 mounts onto the motor shaft 92 between the impeller housing 84 and the motor 14. The belt 18 slips around and rides in the pulleys 30 of the orbital head assemblies 20 and the motor pulley 108. The belt 18 also rides against two tension bearings 110 of a belt tensioner assembly. The belt tensioner assembly as shown includes the tension bearings 110, a spring 112, bolts 114 and a spacer 116. The belt tensioner assembly provides the proper tension on the belt 18 so that the belt 18 remains around the orbital sanding head pulleys 30 and the motor pulley 108.

The wheel assembly includes wheels 118 and an axle 120 attached to a mounting bracket 122. Whereby, the mounting bracket 122 attaches to the main housing 12. The belt cover 16 assembly includes two covers 124 which mount over the belt 18 and pulleys 30, 108 and to the main housing 12. The belt cover assembly 16 provides protection for the user from the moving parts of the floor sander 10. The handle assembly includes a lower bracket 126, an upper bracket 128 and handles 130. The lower bracket 126 has a top 132 and two arms 134 extending downward. A bottom 136 of each arm 134 mounts to the main housing 12. The dust bag 88 is mounted between the top 132 and arms 134 of the lower bracket 126 using straps 138 of the dust bag 88. The upper bracket 128 includes a lower end 140 and an upper end 142. The lower end 140 is rotatably mounted to the lower bracket 126 by a bolt 144 and nut (not shown). The upper end 142 includes the handles 130 extending outward from the upper end 142.

Figure 15:
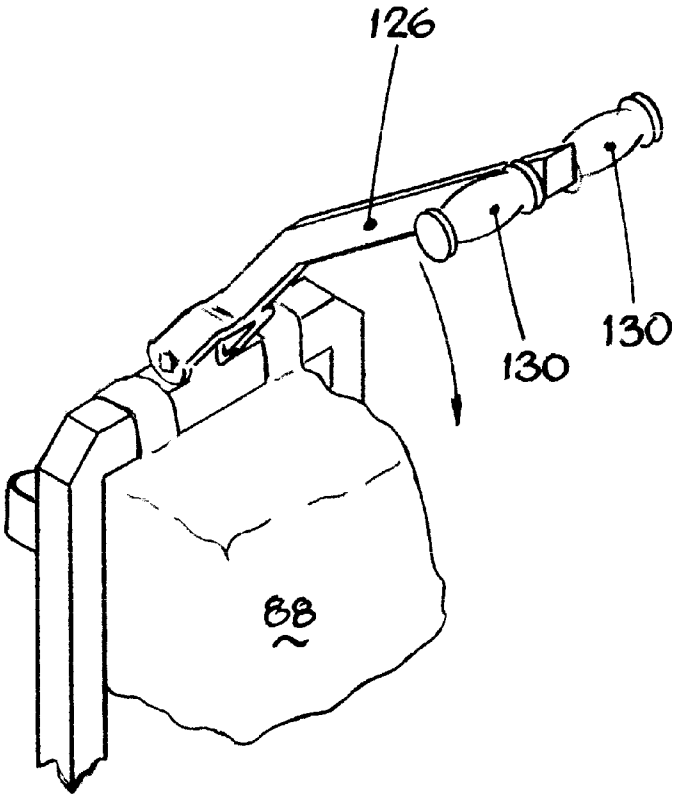
FIG. 15 is a second view showing movement of a handle according to the present invention.
Figure 14:
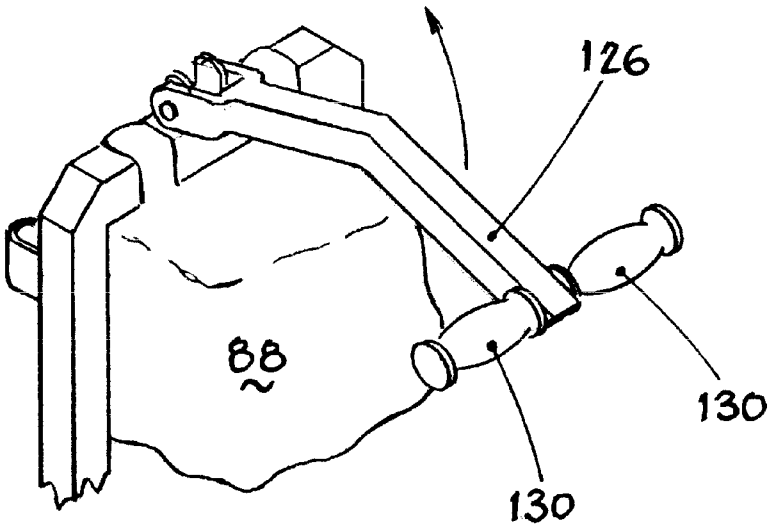
FIG. 14 is a first view showing movement of a handle according to the present invention.
Figure 17:
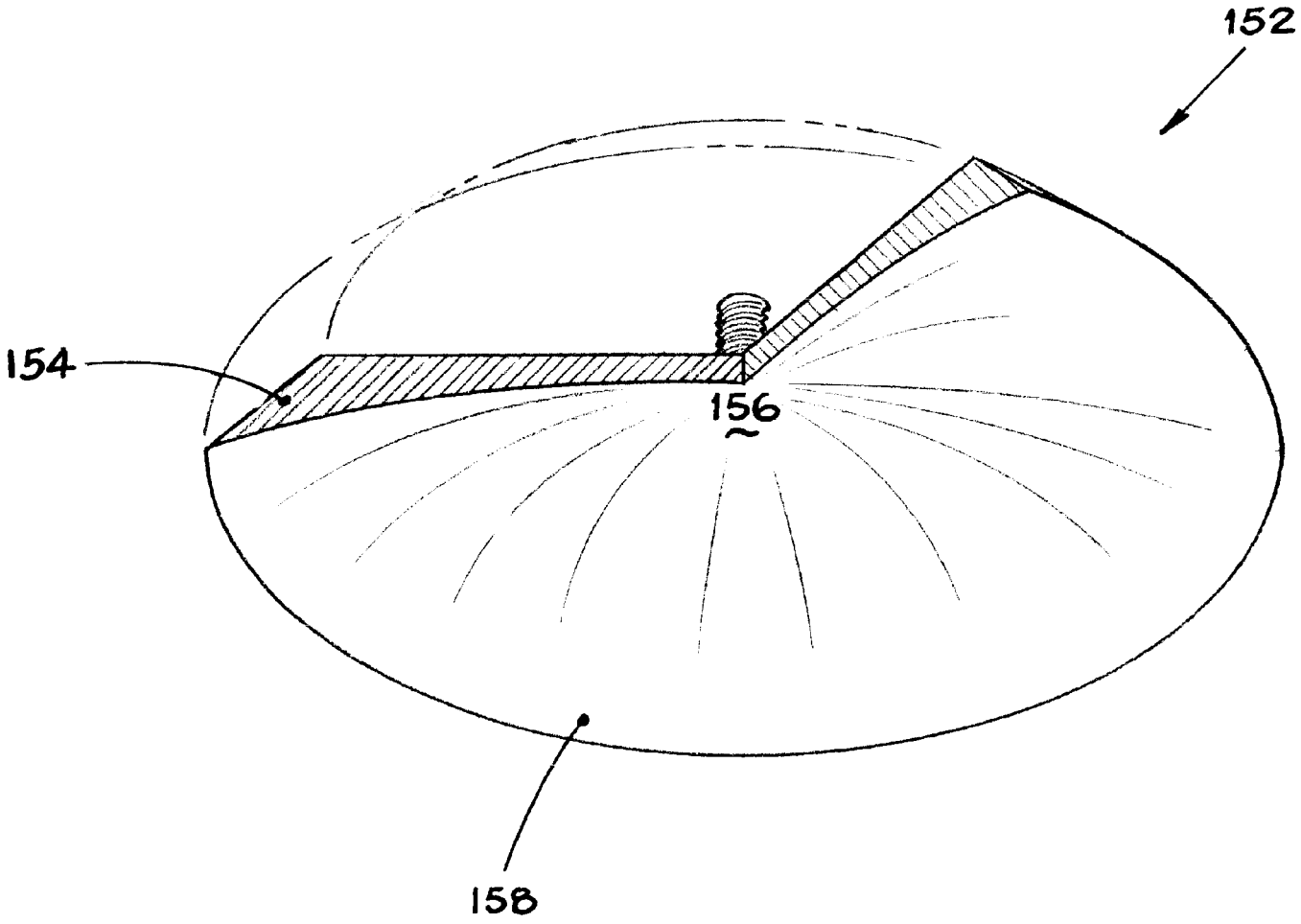
FIG. 17 is a perspective bottom view of a conditioning head having a concave bottom according to the present invention.

The motor 14 provides power to the orbital sand head assemblies 20 for sanding via the belt 18 and pulleys 30, 108. The motor 14 also powers the impeller 82. The impeller 82 and the impeller housing 84 act as a vacuum pulling dust made during sanding from the floor through the suction tube 80. The dust is then carried to the impeller exit 96 and onto the dust bag 88 via the hose 86. The handles 130 are raised to a comfortable position for the user by rotating the upper bracket 128 about the lower bracket 126, as shown in FIGS. 14–15. The conditioning heads 22 have a sand paper pad 150 mounted to a bottom surface 151 of the conditioning head 22. The sand paper pad 150 can be replaced by buffing or polishing pads to easily convert the floor sander 10 to a buffer or polisher. A special version of conditioning head 22 is shown in FIG. 17 as a concave conditioning head 152. The concave conditioning head 152 is made such that a flexible bottom surface 154 of the concave conditioning head 152 is higher in the middle 156 than the outside edges 158, thereby forming a concave bottom surface to receive a sanding pad 150. It has been determined that with the concave conditioning head 152 sanding of a floor can be accomplished in less time and in a more uniform and efficient manner. This because the weight of the floor sander 10 puts pressure on each conditioning head 22 with a flat bottom surface. This pressure only allows the middle of the sanding pad 150 to be applied onto the floor, thereby wasting the outside edges of the sanding pad 150. When the concave conditioning head 152 is used, the weight of the floor sander 10 allows contact of the entire sanding pad 150 with the floor. Thereby utilizing the entire sanding pad 150, which in turn reduces the time it takes to sand a floor.

While different embodiments of the invention has been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

We claim:

1. A floor conditioning system to condition a floor comprising:

at least two orbital head assemblies which provides a rotating orbital action onto said floor during conditioning of said floor, each of said at least two orbital head assemblies including a orbital head and a housing attachment head;

a motor to drive said at least two orbital head assemblies;

a housing to secure said at least two orbital head assemblies and said motor in place;

wherein said housing attachment head attaches directly to said housing;

and wherein said orbital head is rotatably and directly attached to said housing attachment head; and a handle attached to said housing to control said floor conditioning system.

2. The floor conditioning system of claim 1, wherein each of said at least two orbital head assemblies comprises:

an orbital head having a top and bottom, said top adapted to be connected to and rotated by said motor;

a conditioning head attachment shaft extending outward from said bottom of said orbital head and offset from a center of said orbital head, said conditioning head shaft rotatable in relation to orbital head; and a conditioning head having a top adapted to attach to said conditioning head attachment shaft and a bottom for attaching a pad for conditioning the floor.

3. The floor condition system of claim 1, further including a conditioning head having a flexible concave bottom surface to receive a conditioning pad.

4. A floor conditioning system to condition a floor comprising:

at least two orbital head assemblies which provides a rotating orbital action onto said floor during conditioning of said floor, said orbital head assemblies having an orbital head having a top and bottom, said top adapted to be connected to and rotated by said motor; a conditioning head attachment shaft extending outward from said bottom of said orbital head and offset from a center of said orbital head, said conditioning head shaft rotatable in relation to orbital head; and a conditioning bead having a top adapted to attach to said conditioning head attachment shaft and a bottom for attaching a pad for conditioning the floor;

a motor to drive said at least two orbital head assemblies;

a housing to secure said at least two orbital head assemblies and said motor in place;

wherein each of said at least two orbital head assemblies further include a housing attachment head that attaches directly to said housing; and wherein said orbital head is rotatably and directly attached to said housing attachment head; and a handle attached to said housing to control said floor conditioning system.

5. The floor conditioning system of claim 2, further including at least one bearing; wherein said orbital head includes a milled out hole in said bottom of said orbital head offset from said center of said orbital head to receive said at least one bearing, wherein said conditioning head attachment shaft includes a top adapted to be rotatably secured to said at least one bearing and a bottom for receiving said top of said conditioning head.

6. The floor conditioning system of claim 2, wherein said bottom of said conditioning head attachment shaft is a stud and said top of said conditioning head is a socket which fits over said stud.

7. The floor conditioning system of claim 4, further including a main shaft extending from said top of said orbital head; a first bearing to allow said orbital head to rotate and wherein said housing attachment head includes a first milled out hole in a bottom of said housing attachment head to receive said first bearing and allow passage of said main shaft.

8. The floor conditioning system of claim 7, further including a second bearing and wherein said housing attachment head includes a second milled out hole in a top of said housing attachment head to receive said second bearing and allow passage of said main shaft.

9. The floor conditioning system of claim 4, further including a threaded ring; wherein said housing attachment head includes a top, middle and bottom; wherein said bottom includes a collar; wherein said middle is threaded to receive said threaded ring; and wherein said housing attachment head is mounted to said housing by trapping said housing between said threaded ring and said collar, when said threaded ring is threaded on to said middle of said housing attachment head.

10. The floor conditioning system of claim 4, further including a pulley attached to said orbital head to connect said orbital head to said motor.

11. The floor conditioning system of claim 4, further including a belt; wherein said motor includes a pulley; and wherein said at least two orbital head assemblies include a pulley.

12. The floor conditioning system of claim 11, further including a tensioning device to provide tension to said belt.

13. The floor conditioning system of claim 2, further including a dust recovery system, said dust recovery system comprising: a passage in a bottom of said housing to draw dust into said housing; an impeller within said housing to create a suction action to draw said dust into said housing and a dust exit for said dust to exit said housing.

14. The floor conditioning system of claim 2, further including a frame extending from said housing; and wherein said handle is attached to said frame.

15. The floor conditioning system of claim 4, wherein a sanding pad is attached to said conditioning head.

16. The floor conditioning system of claim 4, wherein a polishing pad is attached to said conditioning head.

17. The floor conditioning system of claim 4, wherein there is four orbital head assemblies attached to said housing.

18. The floor conditioning system of claim 2, wherein each of said conditioning heads rotate in a random manner independent of rotation of each of said orbital heads when applying said rotating orbital action onto said floor.

19. The floor condition system of claim 4, said conditioning head having a flexible concave bottom surface to receive a conditioning pad.

20. The floor condition system of claim 4, said conditioning head comprising, a head having flexible bottom surface, said flexible bottom surface having a higher middle than outside edge, thereby forming a concave bottom surface to receive said conditioning pad.

21. The floor condition system of claim 20, wherein said conditioning pad is a sanding pad.

22. A floor conditioning system to condition a floor comprising:

at least two orbital head assemblies which provides a rotating orbital action onto said floor during conditioning of said floor, each of said at least two orbital head assemblies including an orbital head having a top and bottom, said top adapted to be connected to said motor, a conditioning head attachment shaft extending outward from said bottom of said orbital head and offset from a center of said orbital head, said conditioning head shaft rotatable in relation to orbital head, and a conditioning head having a top adapted to attach to said conditioning head attachment shaft and a bottom for attaching a pad for conditioning the floor, and at least one bearing wherein said orbital head includes a milled out hole in said bottom of said orbital head offset from said center of said orbital head to receive said at least one bearing and wherein said conditioning head attachment shaft includes a top adapted to be rotatably secured to said at least one bearing and a bottom for receiving said top of said conditioning head;

a motor to drive said at least two orbital head assemblies;

a pulley attached to said motor;

a pulley attached to said orbital head to connect said orbital head to said motor;

a tensioning device to provide tension to said belt;

a housing to secure said at least one orbital head assembly and said motor in place;

wherein each of said at least two orbital head assemblies further include a housing attachment head that attaches directly to said housing; and wherein said orbital head is rotatably and directly attached to said housing attachment head; and a handle attached to said housing to control said floor conditioning system.

23. The floor conditioning system of claim 22, further including a dust recovery system, said dust recovery system comprising: a passage in a bottom of said housing to draw dust into said housing; an impeller within said housing to create a suction action to draw said dust into said housing and a dust exit for said dust to exit said housing.

24. The floor conditioning system of claim 22, further including a frame extending from said housing; and wherein said handle is attached to said frame.

25. The floor conditioning system of claim 22, wherein there is four orbital head assemblies attached to said housing.

* * * * *